US005623179A

United States Patent [19]

Buhl

[11] Patent Number: 5,623,179

[45] Date of Patent: Apr. 22, 1997

[54] MULTI FIRE SPARK PLUG

[76] Inventor: Richard Buhl, 1702 Stardust La., Arnold, Mo. 63010

[21] Appl. No.: 566,672

[22] Filed: Dec. 4, 1995

[51] Int. Cl.[6] ..... H01T 13/46; H01T 13/22

[52] U.S. Cl. ..... 313/141; 313/143

[58] Field of Search ..... 313/141, 140, 313/143, 326; 123/169 R, 169 EL, 169 MG

[56] References Cited

U.S. PATENT DOCUMENTS

| | | | |
|---|---|---|---|
| 3,958,144 | 5/1976 | Franks | 313/141 |
| 4,916,356 | 4/1990 | Forkum, Jr. | 313/141 |
| 5,007,389 | 4/1991 | Kashiwara et al. | 313/141 |
| 5,189,333 | 2/1993 | Kagawa et al. | 313/143 |
| 5,264,754 | 11/1993 | Hanitijo et al. | 313/140 |
| 5,280,214 | 1/1994 | Johnson | 313/141 |
| 5,369,328 | 11/1994 | Grubber et al. | 313/141 |

*Primary Examiner*—Sandra L. O'Shea
*Assistant Examiner*—Joseph Williams

[57] ABSTRACT

A spark plug for an internal combustion engine having one or more electrode diagonally projecting from a central electrode into a V-shaped grounding window which is cut into the skirt of the spark plug body. The novel electrode suspended in the grounding window provides broader spark dispersion, through a wider arching area, and greatly improved spark plug life.

8 Claims, 2 Drawing Sheets

MULTI FIRE SPARK PLUG

BACKGROUND OF THE INVENTION

I. Field of the Invention

This invention relates to a spark plug for use in internal combusion engines, and more particularly for modern internal engines which can perform efficiently for extended periods, such as 100,000 miles between tune ups.

II. Description of Prior Art

Both diesel engines and gasoline engines work on the principle of internal combustion. The energy created by combustion (burning of fuel) is converted into mechanical energy. In the case of a diesel engine, air is taken into the cylinder and heavily compressed. The air reaches about 1000 degrees F. (538 degrees C.), so when fuel is sprayed into the cylinder it ignites (catches fire). The explosion forces the piston to move.

In a gasoline engine, however, a mixture of fuel and air is taken into the cylinder at a lower compression and temperature. The mixture must be ignited by an electric spark from a plug inserted in the cylinder, and this explosion forces the piston to move and so turn the crankshaft.

When the engine is running, a pulse of electrical energy at a very high voltage is passed to the terminal of the plug. Car engines, of course, have several cylinders, and in this case the distributor passes the electrical pulses to each of the spark plugs in turn.

The center of this conventional spark plug is an electrode which is imbedded in a ceramic insulator. Separated from the end of the electrode center by a narrow gap is another electrode which is grounded to the cylinder block of the engine. The electrical pulse makes a spark jump across the gap between the center electrode and the grounded electrode.

Designs of spark plugs vary considerably. A typical plug has a body made of steel plated with zinc for protection. The screw threads are precisely rolled to international standards. The insulators are made from a rough ceramic material of fired aluminum oxide. The electrodes are normally made from nickel alloys. A gas tight seal made from aluminum oxide powder is placed between the center electrode and the insulator, and also between the insulator and the plug body.

The conventional plug consists essentially of two (2) electrodes, the insulator, containing a central electrode, and the body with its screw thread and earth electrode that extends from the end of the body into near contact with the lower tip of the central electrode. The ignition current coming from the distributor flows through the central electrode and produces the spark between the central electrode and the earth electrode. The ignition voltage, prior to electronic ignitions was about 25,000 volts. With the advent of modern ignition systems, the voltages have risen, depending upon the application, by a multiple of 2 or 3 times those earlier voltages. And with the greatly increased voltage the wear upon electrodes of conventional spark plugs in turn is greatly increased. The optimal gap between electrodes is altered by the increased wear and the plugs must be changed at a greater rate. With conventional spark plugs as a result of use, the sharp corners of the center electrode and the grounding electrode become rounded. This increases the voltage required to fire the plug which can lead to hard starting and misfiring under load.

In order to increase the life of spark plugs, newer, exotic, and more expensive materials have been used in the manufacture of spark plugs both to disperse the heat generated by the higher voltages and to resist pitting and other forms of physical deterioration of the electrodes. An example that incorporates exotic metals is U.S. Pat. No. 3,958,144. Other recent spark plug inventions which profess to increase spark plug life are the three (3) earth electrode design of U.S. Pat. No. 5,189,333, and the split prong designs of U.S. Pat. Nos. 5,264,754 and 4,916,354. U.S. Pat. No. 5,280,214 discloses a spark plug which utilizes an annular ground electrode to give increased spark between the ground electrode and the center electrode. The prior art does not teach the structure or advantages of the spark plug of the present invention described herein.

SUMMARY OF THE INVENTION

The general purpose of the present invention in its preferred embodiment which will be described subsequently in greater detail, is to provide a new and improved spark plug with greatly improved life which can perform efficiently for extended periods, such as 100,000 miles between tune ups. The spark plug of the present invention resembles conventional spark plugs in that it consists of a cylinderical steel shell or body with a portion threaded for engagement with mating threads of an engine port, a tubular ceramic insulator held by the shell, and a central electrode that extends from an upper terminal, for connection to a spark plug wire, axially through the center of the insulator and body.

The upper portion of the spark plug, that is, that portion which is visible when the plug is tightened in its port in the cylinder head is similar, if not identical to conventional spark plugs. The inventive differences are contained in that portion which is threaded into the port. The novel elements of the spark plug of the present invention include a cylindrical extension of the steel sheel or body from the termination of the threaded portion. The extension or skirt portion in the preferred embodiment has four (4) V-shaped windows or apertures or grounding areas, spaced at 90° intervals about the circumferance of the skirt portion.

The novelty of the present invention also extends to the central electrode. As the central electrode extends to the skirt portion of the shell, it is transposed into four (4) electrode projections or elements, spaced 90° apart, which project diagonally through the four (4) windows or apertures. Each of the electrode projections is directed at an angle to maintain a parallel distance between the grounding windows and the electrode projections.

The unique design of this multiple electrode spark plug will spread the wear to four (4) electrodes rather than one. As the electrode projections wear it is expected that sparking will occur at the window with closest proximity to an electrode projection. And as wear continues spark discharge will rotate to the window or windows having the closest proximity to an electrode projection or projections. With four electrodes, electrode wear is dispersed equally amongst the four (4) electrode projections giving much longer effective use of these spark plugs.

In addition to longer spark plug life, the spark plug of the present invention has many other advantages. The broader spark area provided by the four separate electrode projection/window combinations enhance engine performance and efficiency. Further, by providing a larger dissipation area through the four electrode projections, fewer heat ranges are required for varied use applications. It has also been discovered in the development of the spark plug of the present invention that the plug is not limited to the shape of conventional central and grounding electrodes. With the present invention the electrode projections can be oval, V-shaped, round, or grooved amongst other shapes. The electrodes of the present invention may be constructed of conventional metals and do not require exotic materials.

There has thus been outlined broadly the important features of the present invention in order that the detailed description thereof that follows may be better understood, and in order that the present contributions may be better appreciated. There are, of course, additional features of the invention that will be described hereinafter plus other embodiments, all of which form the subject matter of the claims appended hereto. Those skilled in the art will appreciate that the concept, upon which this disclosure is based, may readily be utilized as a basis for designing of other structures for carrying out the several purposes of the present invention. It is important, therefore, that the claims be regarded as including such equivalent construction so far as they do not depart from the spirit and scope of the present invention.

As such it is an object of the invention to provide a new and improved spark plug that will increase fuel economy as a direct result of the ability of the spark plugs to self adjust by use to give maximum engine efficiency. It is a further object of the present invention to increase engine horsepower by broader spark dispersion that enhances engine function and efficiency. It is a still further object of the present invention to reduce exhaust emissions as the consistent spark will reduce partially combusted and unburned gases.

Still another object of the present invention is to eliminate carbon fouling because multiple electrode projections provide alternative grounding paths. Even another object of the present invention is to present a new spark plug long term, high mileage use and which can be manufactured inexpensively from conventional and even recycled materials.

Still yet another object of the present invention is to provide a new and improved spark plug which has all the advantages of prior art spark plugs and none of the disadvantages. An even further object of the present invention is to provide a new and improved spark plug which provides in the apparatuses and methods of the prior art some of the advantages thereof while simultaneously overcoming some of the disadvantages normally associated therewith.

These together with other objects of the invention along with the various features of novelty which characterize the invention are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated preferred embodiments of the invention.

DESCRIPTION OF THE PREFERRED EMBODIMENT

Figure 1:
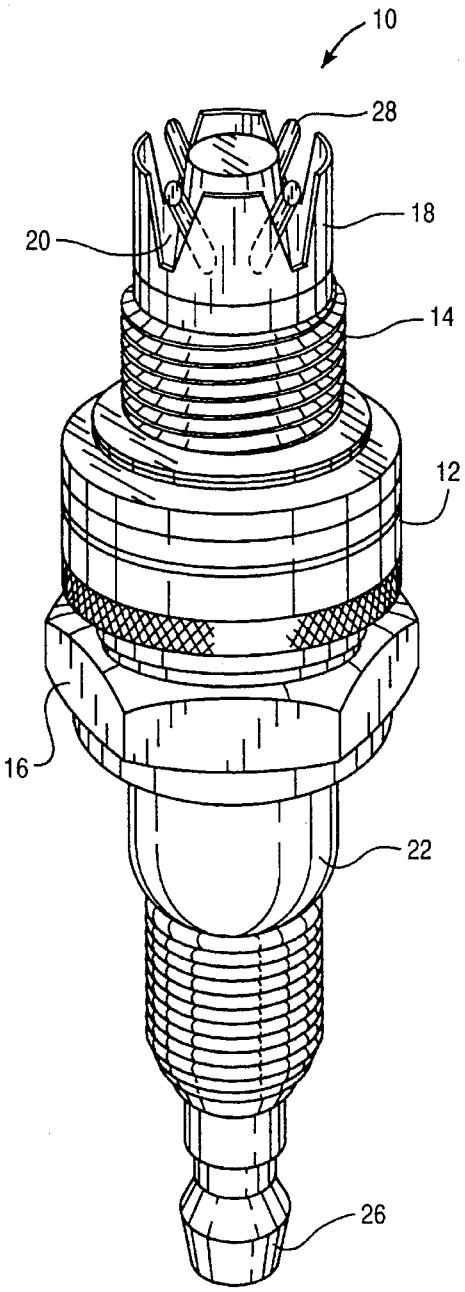
FIG. 1 is a perspective view of the preferred embodiment of the present invention displaying four (4) diagonally disposed electrode projections or elements extending from a central electrode through V-shaped grounding windows or apertures.
Figure 2:
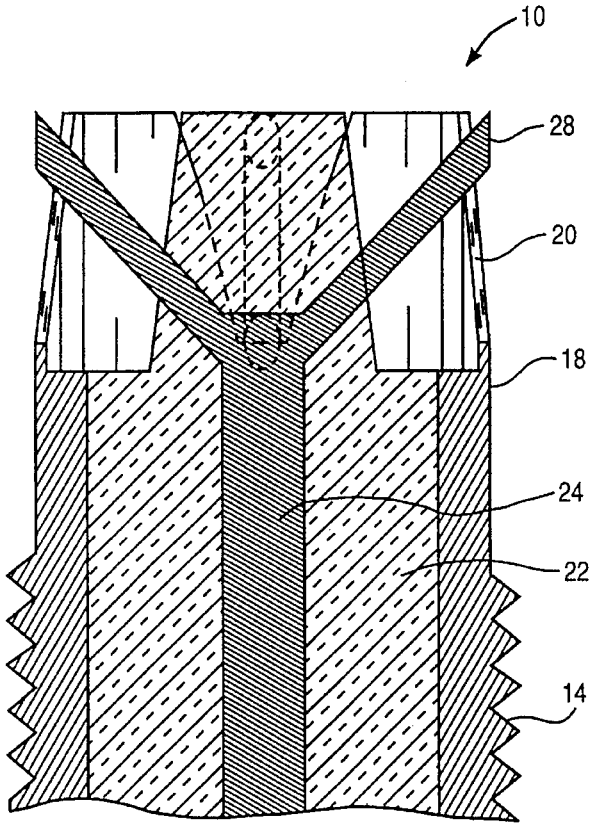
FIG. 2 is an exploded cross-sectional view of the preferred embodiment of a spark plug of the present invention displaying the diagonal projections from the central electrode.
Figure 3:
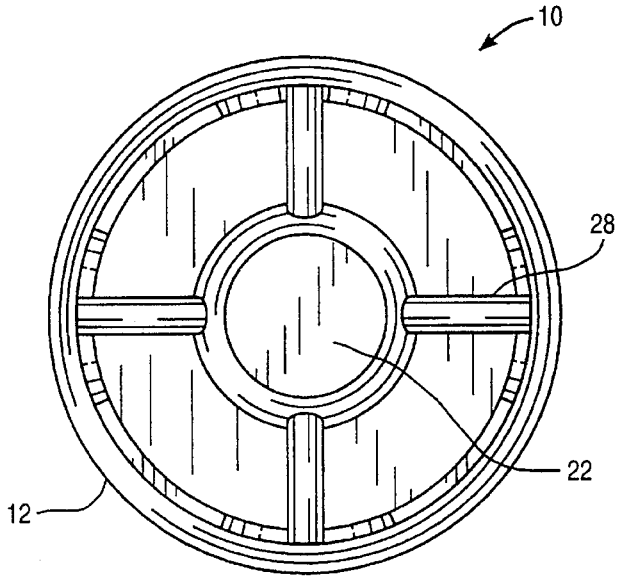
FIG. 3 is a bottom plan view of the spark plug that is the preferred embodiment of the present invention.

Referring to FIGS. 1, 2, and 3 of the drawings, there is presented the preferred embodiment of the present invention. As with a conventional spark plug, the spark plug 10 of the present invention shown in FIG. 1 includes a steel shell or body 12 which holds and encompasses a ceramic (or other equivalent material) insulator 22, and a central electrode 24 imbedded in the insulator. The upper portion of the spark plug 10 is similar to conventional spark plugs. The inventive differences of the spark plug 10 are evident in the lower portion of the plug.

The shell or body 12 is comprised of a threaded cylindrical portion 14 for engagement with the internal threads of an engine cylinder port, a hexagonal nut portion 16 for wrench tightening the plug 10, and a cylindrical skirt portion 18 that extends from the lower end of the threaded portion 14. Four (4) V-shaped windows or grounding areas 20, spaced 90 degrees apart about the axis of the spark plug are cut into the skirt portion 14. The central electrode 24 commences with a high voltage terminal connection 26 and extends axially through the center of the insulator 22 to a point near the commencement of the windows 20. At that point the central electrode is transformed into four (4) obliquilely disposed electrode projections or elements 28. The elements 28 extend from the tapered lower end of the insulator 22 and are equally spaced at 90° intervals about the axis of the spark plug. Each element or electrode projection 28 extends through a window 20 in the skirt 18. The outer ends of each element 28 terminates at the outer periphery of the skirt 18.

The elements 28 are set at an angle to keep the parrel distance between the electrode projections 28 and the V of the windows uniform.

In operation high tension voltage passes through the central electrode 24 to the electrode projection 28. The voltage will discharge in the form of a spark that jumps from the element 28 to the edges of a window 20. The spark will spread over the edges of the window. Since there are four projections 28 and four windows 20 there could be four separate sparks. It is expected in operation that sparking will occur first at the window 20 with the closest proximity to an electrode projection 28. And as wear continues spark discharge will rotate to the window 20 or windows 20 having the closest proximity to an electrode projection 28 or projections. As the electrode projections and windows wear the angular relation between the window and the related projection will remain the same. Because there are four (4) windows/electrode projection combinations and because the spark is spread over a greater area, the electrodes will wear much more slowley than the electrodes of conventional plugs. In operation it is expected that the spark will consistently rotate to the smallest gap between window 20 and projection 28 and that there will be fairly even wear amongst the projections 28.

Figure 4:
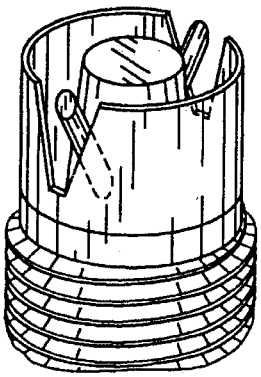
FIG. 4 is a perspective view of another embodiment of the present invention displaying two (2) diagonally disposed electrodes extending from a central electrode into V-shaped grounding windows.
Figure 5:
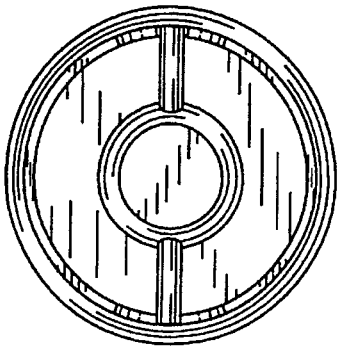
FIG. 5 is a bottom plan view of the embodiment of the present invention that is shown in FIG. 4.
Figure 6:
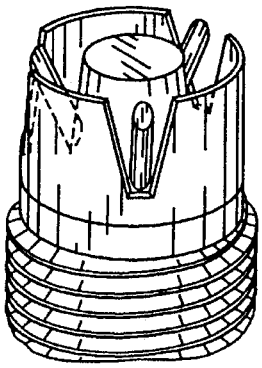
FIG. 6 is a perspective view of a further embodiment of the present invention displaying three (3) diagnonally disposed electrodes extending from a central electrode into V-shaped grounding windows.
Figure 7:
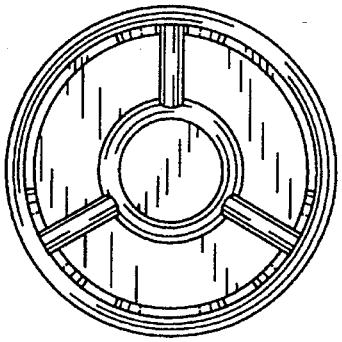
FIG. 7 is a bottom plan view of the spark plug that is displayed in FIG. 6.
Figure 8:
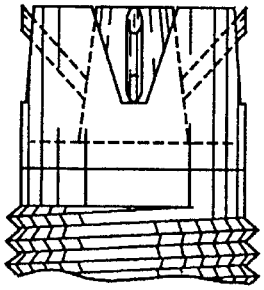
FIG. 8 is a side elevation of the present invention displaying elliptically shaped, diagonally disposed, elements or electrodes extending from the central electrode into V-shaped windows.

The preferred embodiment as is depicted in FIGS. 1 through 3 includes four (4) projections 28 and four windows 20. This invention is not limited to that configuration. Other options are illustrated in FIGS. 4 through 11. A spark plug of the present invention can be manufactured with less projections and windows as shown by FIGS. 4 and 5 (two projections and two windows) and by FIGS. 6 and 7 (three projections and three windows). A spark plug having more projections and windows than those of the present invention is also within the conception of the present invention.

Figure 9:
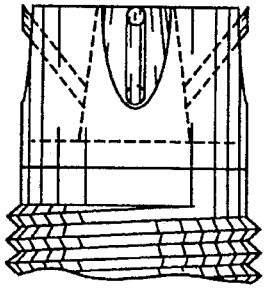
FIG. 9 is a side elevation of the present invention displaying diagonally disposed, electrodes or elements extending from the central electrode into corresponding elliptically shaped windows.
Figure 10:
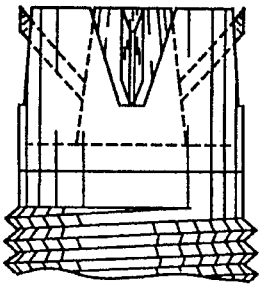
FIG. 10 is a side elevation of the present invention displaying diagonally disposed thin walled V-shaped electrodes or elements extending from the central electrode into V-shaped windows with the sides of the V-shaped electrodes parallel to the edges of the V-shaped windows.
Figure 11:
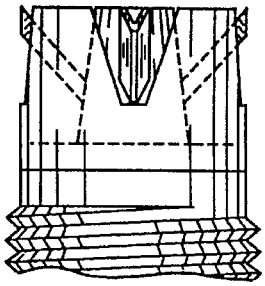
FIG. 11 is a side elevation of the present invention displaying diagonally disposed, thick walled, V-shaped electrodes extending from the central electrode into the V-shaped windows with the sides of the V-shaped electrodes parallel to the edges of the V-shaped windows.

Other features of the present invention are illustrated by FIGS. 8 through 11. The projections are not limited to the rectangular or circular shapes of conventional spark plugs. The projections may be V-shaped (FIGS. 10 and 11), elliptical (FIG. 8), square, or rectangular, or circular (FIG. 9) and the windows may be elliptical (FIG. 9).

While the invention has been described with reference to the specific embodiment described, those descriptions are only illustrative and are not to be construed as limiting the invention. With respect to the above descriptions, then, it is to be realized that the optimal dimensional relationships for the parts of the invention include variations in size, materials, shape, configurations, form, function, and manner of operation assembly and use, are deemed readily apparent and obvious to those skilled in the art and all equivalent relationships to those illustrated in the drawings and described in the specification are intended to be encompassed by the present invention.

Therfore, the foregoing is considered as illustrative only of the principles of the invention. Further, since numerous modifications and changes will readily occur to those skilled in the art, it is not desired to limit the invention to the exact construction and operation shown and described and accordingly, all suitable modifications and equivalents may be resorted to falling within the scope of the invention.

What is claimed as being new and desired to be protected by Letters Patent of the United States is as follows:

1. A spark plug for an internal combustion engine comprising, a metal body having a threaded portion for engagement with the cylinder head of the engine and having an extended skirt as a ground element, said skirt having a plurality of apertures; a cylindrical ceramic insulator secured within the body; and an electrode extending through the center of the insulator, the electrode transforming into a plurality of oblique oriented projections which extend into and intersect said skirt through the apertures, whereby a spark generated by said electrode can be conveyed along any of said projections and passed to a lateral edge of any of said apertures, whereby deterioration of spark gap distance is minimized between said projections and said skirt ground element.

2. The spark plug of claim 1 wherein the apertures and the projections are dispersed at 90 degree intervals about the axis of the spark plug.

3. The spark plug of claim 1 wherein the projections are maintained at a position equidistant from said lateral edges of the apertures.

4. The spark plug of claim 1 wherein the projections have a circular cross-section.

5. The spark plug of claim 1 wherein the projection have an elleptical cross-section.

6. The spark plug of claim 1 wherein the apertures are V-shaped.

7. The spark plug of claim 1 wherein the projections are maintained at a position equidistant from said lateral edges of the apertures, and the apertures are V-shaped.

8. The spark plug of claim 7 wherein the projections have a V-shaped cross-section.

* * * * *